US008251145B2

(12) United States Patent
Renshaw et al.

(10) Patent No.: US 8,251,145 B2
(45) Date of Patent: Aug. 28, 2012

(54) PRESSURE RELIEVING TRANSITION JOINT

(75) Inventors: William Shaun Renshaw, Edmonton (CA); Steven Ronald Fipke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/366,484

(22) Filed: Feb. 6, 2012

(65) Prior Publication Data

US 2012/0132427 A1 May 31, 2012

Related U.S. Application Data

(63) Continuation of application No. 13/075,071, filed on Mar. 29, 2011, now Pat. No. 8,171,995, which is a continuation of application No. 12/237,646, filed on Sep. 25, 2008, now Pat. No. 7,984,762.

(51) Int. Cl.
*E21B 43/08* (2006.01)
*E03B 3/22* (2006.01)
*E03B 3/11* (2006.01)

(52) U.S. Cl. ..... 166/313; 166/50; 166/227; 166/278

(58) Field of Classification Search ..... 166/313, 166/278, 50, 234, 227
See application file for complete search history.

(56) References Cited

U.S. PATENT DOCUMENTS

| | | | | |
|---|---|---|---|---|
| 2,452,920 | A * | 11/1948 | Gilbert | 166/297 |
| 5,340,160 | A * | 8/1994 | Meijers et al. | 285/15 |
| 5,901,798 | A | 5/1999 | Herrera et al. | |
| 6,012,526 | A * | 1/2000 | Jennings et al. | 166/298 |
| 7,013,979 | B2 * | 3/2006 | Richard | 166/369 |
| 7,213,652 | B2 * | 5/2007 | Hepburn et al. | 166/313 |
| 7,213,654 | B2 * | 5/2007 | Plucheck et al. | 166/380 |
| 7,318,481 | B2 * | 1/2008 | Richard | 166/369 |
| 7,644,773 | B2 * | 1/2010 | Richard | 166/382 |
| 7,703,520 | B2 * | 4/2010 | Dusterhoft | 166/278 |
| 7,984,762 | B2 * | 7/2011 | Renshaw et al. | 166/313 |
| 2004/0035590 | A1 * | 2/2004 | Richard | 166/384 |
| 2004/0159435 | A1 * | 8/2004 | Plucheck et al. | 166/313 |
| 2004/0261990 | A1 * | 12/2004 | Bosma et al. | 166/50 |

(Continued)

FOREIGN PATENT DOCUMENTS

GB 2447542 A1 9/2008

(Continued)

OTHER PUBLICATIONS

Foreign Communication From a Related Counterpart—International Search Report and Written Opinion, PCT/US2009/057142, May 25, 2011.

Foreign Communication From a Related Counterpart—Notification Concerning Transmittal of International Preliminary Report on Patentability, PCT/US2009/057142, Jun. 9, 2011.

(Continued)

*Primary Examiner* — Jennifer H Gay
(74) *Attorney, Agent, or Firm* — Conley Rose, P.C.

(57) ABSTRACT

A method of completing a wellbore having a branch wellbore extending outwardly from a window in a parent wellbore comprises positioning a tubular string in the window, wherein the positioning comprises deflecting the tubular string from the parent wellbore into the branch wellbore. The method also comprises providing a particulate barrier outside and against the tubular string proximate the window, the particulate barrier substantially excluding transport of particulate matter from the branch wellbore into the parent wellbore outside of the tubular string through the window. The method also comprises the tubular string passing fluid into the tubular string proximate the window from a formation proximate to the window while substantially excluding transport of particulate matter from the formation proximate to the window into the tubular string.

20 Claims, 7 Drawing Sheets

U.S. PATENT DOCUMENTS

| | | | | |
|---|---|---|---|---|
| 2005/0077052 | A1* | 4/2005 | Ohmer | 166/384 |
| 2005/0173130 | A1* | 8/2005 | Richard | 166/384 |
| 2005/0205263 | A1* | 9/2005 | Richard | 166/369 |
| 2005/0241831 | A1 | 11/2005 | Steele et al. | |
| 2006/0086501 | A1* | 4/2006 | Creel et al. | 166/281 |
| 2007/0227731 | A1* | 10/2007 | Contant | 166/278 |
| 2008/0099201 | A1 | 5/2008 | Sponchia et al. | |
| 2008/0283240 | A1* | 11/2008 | Baaijens et al. | 166/236 |
| 2009/0173490 | A1* | 7/2009 | Dusterhoft et al. | 166/229 |
| 2009/0173497 | A1* | 7/2009 | Dusterhoft | 166/276 |
| 2010/0051262 | A1* | 3/2010 | Dusterhoft et al. | 166/236 |
| 2010/0051270 | A1* | 3/2010 | Dusterhoft et al. | 166/278 |
| 2010/0077594 | A1* | 4/2010 | Richard | 29/505 |
| 2011/0174480 | A1* | 7/2011 | Renshaw et al. | 166/117.5 |

FOREIGN PATENT DOCUMENTS

| | | | |
|---|---|---|---|
| WO | WO2006003112 | A1 | 1/2006 |
| WO | WO2006003113 | A1 | 1/2006 |

OTHER PUBLICATIONS

Office Action dated Feb. 18, 2010, U.S. Appl. No. 12/237,646, filed on Sep. 25, 2008 1391-81600.

Office Action dated Jun. 23, 2010, U.S. Appl. No. 12/237,646, filed on Sep. 25, 2008 1391-81600.

Office Action dated Oct. 19, 2010, U.S. Appl. No. 121237,646, filed on Sep. 25, 2008 1391-81600.

Final Office Action dated Feb. 3, 2011, U.S. Appl. No. 12/237,646, filed on Sep. 25, 2008 1391-81600.

Notice of Allowance dated Apr. 1, 2011, U.S. Appl. No. 12/237,646, filed on Sep. 25, 2008 1391-81600.

Office Action dated Aug. 8, 2011, U.S. Appl. No. 13/075,071, filed on Mar. 29, 2011 1391-81607.

Final Office Action dated Nov. 25, 2011, U.S. Appl. No. 13/075,071, filed on Mar. 29, 2011 1391-81607.

Notice of Allowance dated Jan. 6, 2012, U.S. Appl. No. 13/075,071, filed on Mar. 29, 2011 1391-81607.

* cited by examiner

PRESSURE RELIEVING TRANSITION JOINT

CROSS-REFERENCE TO RELATED APPLICATIONS

This application is a continuation of and claims priority to U.S. patent application Ser. No. 13/075,071, filed Mar. 29, 2011, entitled "Pressure Relieving Transition Joint," by William Shaun Renshaw, et al., which is a continuation of U.S. patent application Ser. No. 12/237,646, filed Sep. 25, 2008, entitled "Pressure Relieving Transition Joint," by William Shaun Renshaw, et al., and issued as U.S. Pat. No. 7,984,762, on Jul. 26, 2011, both of which are incorporated herein by reference in their entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wells may comprise a plurality of wellbores. For example, a main wellbore may be drilled and one or more branch wellbores may be drilled off of the main wellbore. The branch wellbores may be referred to in some contexts as lateral wellbores. Wells comprising at least one lateral wellbore may be referred to in some contexts as multilateral wells. A transition joint may be used in completion of a multilateral well, for example to complete Technical Advance Multilateral (TAML) level 3 completions, to provide a useful transition between a parent wellbore and a branch wellbore bored off of the parent wellbore. A parent wellbore may be the main wellbore or may itself be a branch wellbore drilled off of the main wellbore or off of another branch wellbore.

Sealing off a formation proximate to the junction of the parent wellbore with the branch wellbore may be called for to avoid formation particulate matter, for example fines and/or sand, passing into the parent wellbore and/or the branch wellbore. Particulate matter in the wellbores may plug or prematurely wear production equipment and/or cause other problems. In some circumstances, a pressure differential may exist between the formation proximate to the junction of the parent wellbore with the branch wellbore. The pressure differential may exert unwanted stress on a seal of the transition joint.

SUMMARY

In an embodiment, a method of completing a wellbore having a branch wellbore extending outwardly from a window in a parent wellbore is disclosed. The method comprises positioning a tubular string in the window, wherein the positioning comprises deflecting the tubular string from the parent wellbore into the branch wellbore. The method also comprises providing a particulate barrier outside and against the tubular string proximate the window, the particulate barrier substantially excluding transport of particulate matter from the branch wellbore into the parent wellbore outside of the tubular string through the window. The method also comprises the tubular string passing fluid into the tubular string proximate the window from a formation proximate to the window while substantially excluding transport of particulate matter from the formation proximate to the window into the tubular string.

In another embodiment, a completion tool for a well having a branch wellbore extending outwardly from a window in a parent wellbore is disclosed. The completion tool comprises a metal pipe having an upper end and a lower end, a pipe wall opening, and a plurality of apertures. The completion tool also includes a particulate blocking member coupled to the metal pipe. After installation, the upper end is contained in the parent wellbore upwards from the window and the lower end is contained in the branch wellbore. After installation, the pipe wall opening couples the parent wellbore downwards from the window to the parent wellbore upwards from the window, and the apertures relieve pressure on the particulate blocking member from a formation proximate to the window while blocking transport of particulate matter from the formation proximate to the window into the metal pipe and the particulate blocking member blocks transport of particulate matter from the formation around the metal pipe into the parent wellbore.

In another embodiment, a transition joint seal for coupling a parent wellbore to a branch wellbore extending outwardly from a window in the parent wellbore is provided. The transition joint seal comprises a metal pipe and a swell seal. The metal pipe has a wall opening along a first side of the pipe. The swell seal is coupled to a middle portion of the metal pipe and is swellable in the wellbore by increasing in a volume of the swell seal to promote sealing between the window and the metal pipe. A plurality of apertures in the metal pipe align with a plurality of apertures in the swell seal, and the apertures in the metal pipe substantially block transport of particulate matter from a reservoir proximate to the window into the wellbore and allow fluid flow from the reservoir into the wellbore.

In another embodiment, a transition joint seal for coupling a parent wellbore to a branch wellbore extending outwardly from a window in the parent wellbore is disclosed. The transition joint seal comprises a screen structure having a wall opening along a first side of the screen structure and a swell seal. The swell seal is coupled to a middle portion of the screen structure, the swell seal being swellable in the wellbore by increasing in a volume of the swell seal to promote sealing between the window and the screen structure and the swell seal having a plurality of apertures. The screen structure substantially blocks transport of particulate matter from a formation proximate to the window into the wellbore and allows fluid flow from the formation proximate to the window through the apertures in the swell seal into the wellbore.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
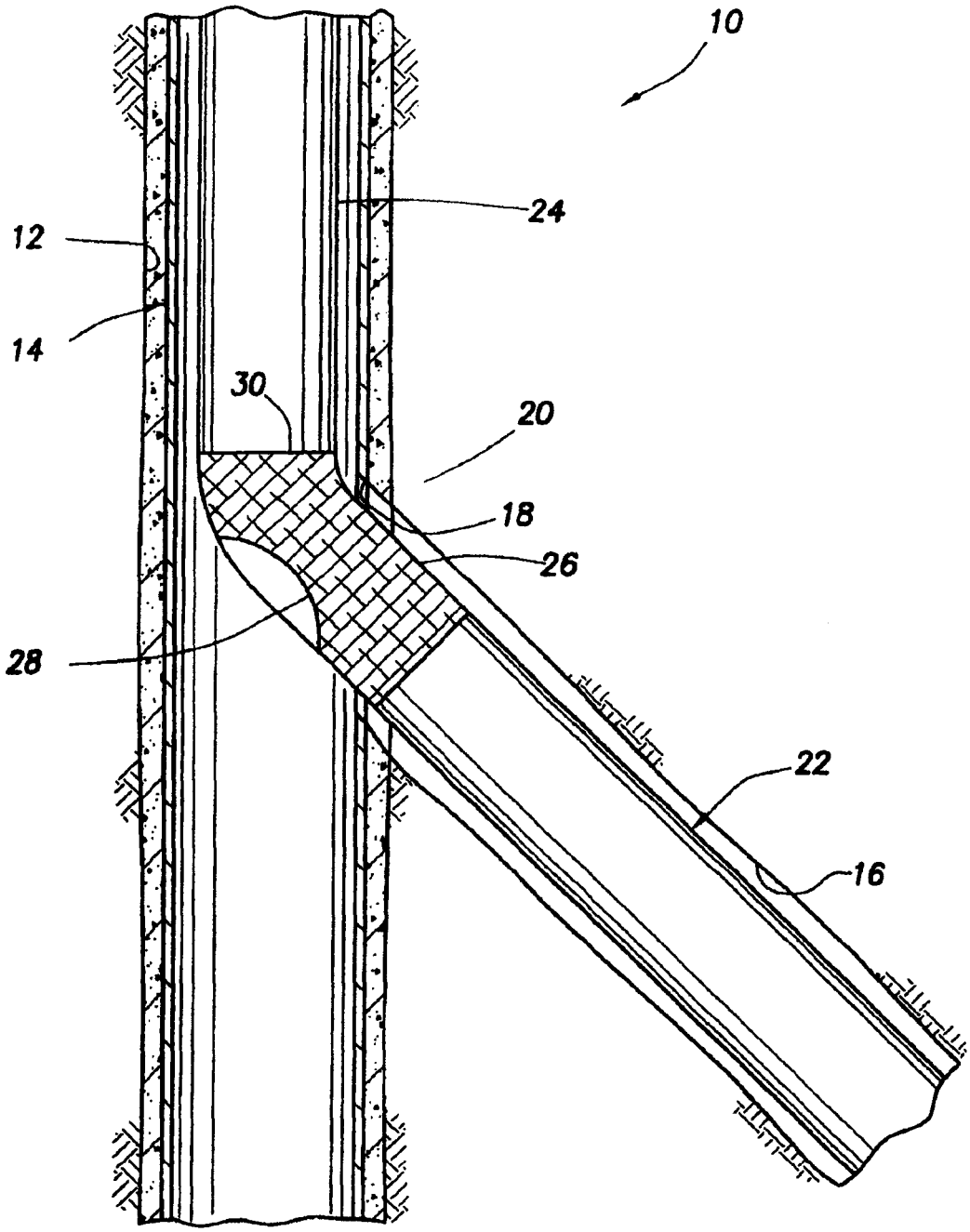
FIG. 1 is an illustration of a well completion system according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

A pressure relieving transition joint is disclosed that achieves the desirable objective of blocking or reducing propagation of particulate matter, such as fines and/or sand, into a parent wellbore and/or a branch wellbore drilled off of the parent wellbore while also avoiding collapse under stress from pressure from a formation proximate to the junction of the branch wellbore and the parent wellbore. In an embodiment, the pressure relieving transition joint has one or more apertures facing the formation that are operable to pass fluid such as liquids and/or gases flowing from the formation into the wellbore while also blocking or substantially reducing propagation of particulate matter into the wellbore. The admission of fluids through the apertures reduces the pressure from the formation on the transition joint, thereby reducing the force on the transition joint from a pressure differential between the outside and the inside of the transition joint. In an embodiment, the contemplated pressure relieving transition joint reduces a pressure differential between the wellbore and the formation proximate to the junction of the branch wellbore and the parent wellbore, immediately at the junction.

A particulate barrier may be provided between the pressure relieving transition joint, the parent wellbore, and the branch wellbore that substantially excludes transport of particulate matter, for example fines and/or sand, from the formation proximate the junction of the parent wellbore and the branch wellbore around the outside of the pressure relieving transition joint into the pressure relieving transition joint. The particulate barrier may be provided by a swelling seal. In an embodiment, the transition joint comprises a swelling seal to form a seal between the transition joint and a window drilled through the parent wellbore to drill the branch wellbore. The swelling seal, which may also be referred to in some contexts as a swellable seal, may exclude fluids as well as particulate matter from flowing around the outside of the pressure relieving transition joint into the pressure relieving transition joint and/or into the parent wellbore. Apertures in a metal tubular portion of the transition joint align with at least some of apertures in the swelling seal in a portion of the transition joint facing the window. The apertures permit fluid flow from the formation proximate to the window to flow through the swelling seal and the metal tubular, thereby reducing or eliminating a pressure differential between the formation and the wellbore.

In another embodiment, the particulate barrier may be provided by at least one of injection foam or injection gel that is applied after or in coordination with positioning the pressure relieving transition joint in the junction between the parent wellbore and the branch wellbore. After being injected, the foam and/or gel may set and provide a seal to block particulate matter from entering the pressure relieving transition joint through gaps between the pressure relieving transition joint and the junction of the parent wellbore and the branch wellbore.

In an embodiment, the particulate barrier comprises packing of particulate matter into gaps between the pressure relieving transition joint, the parent wellbore, and the branch wellbore. This packing of particulate matter may result, after the pressure relieving transition joint is positioned in the junction between the parent wellbore and the branch wellbore, from passing fluid from the formation proximate to the junction into the wellbore. This packing of particulate matter may continue to admit fluids from the formation proximate to the junction to pass into the wellbore while substantially blocking and/or excluding transport of particulate matter into the pressure relieving transition joint.

It is understood that in each case above the particulate barrier acts substantially as a barrier or block to movement and/or migration of particulate matter into the pressure relieving transition joint from the formation proximate to the junction between the parent wellbore and the branch wellbore and not necessarily a barrier composed of particulates. In the last case, however, the particulate barrier also happens to be composed of particulates.

When installed in a wellbore, the pressure relieving transition joint will pass hydrocarbons produced from production zones in the parent wellbore and/or the branch wellbore below and/or beyond the pressure relieving transition joint, through the transition joint, and upwards into the wellbore above the transition joint. Additionally, the pressure relieving transition joint will provide access for downhole tools through the transition joint to the parent wellbore and the branch wellbore below and/or beyond the transition joint.

In an embodiment, the size of apertures in the metal tubular portion may be effective to block or reduce propagation of particulate matter into the wellbore. For example, in an embodiment, the metal tubular is constructed of slotted tubing wherein the slots are effectively sized to block or reduce propagation of particulate matter into the wellbore. In an embodiment, slotted tubing having slots with a width in the range from about 0.01 inches to about 0.04 inches and a length in the range from about 1.5 inches to about 3 inches may be employed, but in other embodiments a different width and/or length slot may be employed. In an embodiment, the size of the slots in the slotted tubing may be selected based on the grain size distribution that is expected at the location where the transition joint will be installed in the wellbore. In another embodiment, a screen, such as a sand screen, may be coupled to the metal tubular portion in association with the apertures to block and/or reduce propagation of particulate matter into the wellbore. In yet another embodiment, pressure relief valves may be installed into the apertures in the metal tubular portion to relieve any pressure differentials while also blocking and/or reducing propagation of particulate matter into the wellbore.

Turning now to FIG. 1, a well completion system 10 is discussed. In the following description of the system 10 and other apparatus and methods described herein, directional terms such as "above," "below," "upper," and "lower," etc., are used for convenience in referring to the accompanying drawings. "Above" means relatively closer to the earth's surface along a wellbore, and the term "below" means relatively farther from the earth's surface. It is understood that the several embodiments of the present disclosure may be utilized in various orientations, such as inclined, inverted, horizontal, vertical, etc., and in various configurations, without departing from the principles set forth herein.

In FIG. 1, a main or parent wellbore 12 has been drilled and then lined with casing 14. The parent wellbore 12 may extend continuously to the earth's surface, or it may be a branch of another wellbore. In another embodiment, however, the parent wellbore 12 may be uncased and an open wellbore. If the parent wellbore 12 is cased, the wellbore can be considered the interior of the casing 14.

A branch wellbore 16 is drilled extending outwardly from a window 18 formed through a sidewall of the casing 14. The window 18 can be formed before or after the casing 14 is installed in the parent wellbore 12. For example, the window 18 could be formed by anchoring a whipstock (not shown) in the casing 14, and then deflecting a mill laterally off of the whipstock to cut the window 18 through the casing sidewall.

A formation or zone 20 surrounds the intersection and/or junction between the parent and branch wellbores 12, 16. The formation 20 may be said to be proximate to the junction between the parent and branch wellbores 12, 16. In order to seal off the formation 20 from the interior of the parent wellbore 12, while also providing a useful transition between the parent and branch wellbores 12, 16, an assembly 22 is positioned in the window 18. The assembly 22 is depicted as including a tubular string 24 having a transition joint 26 interconnected therein. In some contexts, the assembly 22 may be referred to as a completion tool. In some contexts, the tubular string 24 may be referred to as a metal tubular having an upper end and a lower end.

During run in of the assembly 22, a lower end of the tubular string 24 is deflected into branch wellbore 16, for example, by using a whipstock or other deflector positioned in the parent wellbore 12. After run in of the assembly 22, the lower end of the tubular string 24 is contained in the branch wellbore 16 and an upper end of the tubular string 24 is contained in the parent wellbore 12. The lower end of the tubular string 24 may be cemented in the branch wellbore 16, if desired.

The transition joint 26 has an opening 28 formed through a sidewall thereof. In some contexts, the opening 28 may be referred to as a pipe wall opening. The opening 28 may be formed in the sidewall of the transition joint 26 before or after run in of the assembly 22. The opening 28 provides fluid communication (and preferably access) between an interior of the tubular string 24 and the parent wellbore 12 external to the tubular string 24 below the window 18. The opening 28, in some contexts, may be said to couple the parent wellbore 12 downwards from the window 18 to the parent wellbore 12 upwards from the window 18.

In an embodiment, a sealing material 30 may be provided on the transition joint 26. In some contexts, the sealing material 30 may be referred to as a blocking member. The sealing material 30 may be provided in the form of a coating adhered externally to the transition joint 26. However, other methods of attaching the sealing material 30 to the transition joint 26 may be used. In an embodiment, the sealing material 30 is not a coating but is a continuous sleeve of sealing material 30 installed over the assembly 22 at the transition joint 26 that adheres to the transition joint 26 by friction. In some contexts, the sealing material 30 may be referred to as a swellable seal. At least some of the apertures in the sealing material 30 are aligned with at least some of the apertures in the transition joint 26 and/or the tubular string 24. An opening in the sealing material 30 substantially aligns with the opening 28 in the tubular string 24. In an embodiment, it is not required that all of the apertures in the sealing material 30 align with apertures in the transition joint 26, and it is not required that all of the apertures in the transition joint 26 align with apertures in the sealing material 30. In some embodiments, no sealing material 30 is applied to the transition joint 26 until the transition joint 26 is installed in the junction between the parent wellbore 12 and the branch wellbore 16 when a gel and/or foam is injected at the junction. The gel and/or foam may set to form a seal between the transition joint 26 and the junction between the parent wellbore 12 and the branch wellbore 16. In some contexts, the sealing material 30 may be said to provide a particulate barrier outside and against the tubular string 24 proximate the window 18.

The apertures unload pressure that may be present in the formation 20 so that the pressure differential between the formation 20 and the parent and branch wellbore 12, 16 is reduced to a manageable magnitude, for example a magnitude that is insufficient to breach the seal formed by the sealing material 30 when the assembly 22 is installed into the window 18. In an embodiment, it is contemplated that the apertures unload pressure to reduce the differential pressure to a magnitude of less than about 50 pounds per square inch (PSI). In an embodiment, the pressure gradient between the formation 20 and the parent and branch wellbores 12, 16 may be directed substantially perpendicular to the side of the transition joint 26 facing the formation 20 proximate to the window 18. Blocking means and/or devices are provided for preventing propagation of particulate matter from the formation 20 into the parent and branch wellbores 12, 16. The blocking means may be provided by sand screens coupled to the transition joint 26. The blocking means may be provided by permeable filters coupled to the transition joint 26. The blocking means may be provided by use of slotted pipe material in forming the tubular string 24 and/or the transition joint 26, for example slotted pipe having slots in the range of about 0.01 inches to about 0.04 inches wide and in the range of about 1.5 inches to about 3 inches long. The blocking means may be provided by pressure relief valves installed in the apertures in the transition joint 26. The blocking means may be said to exclude or block transport of particulate matter from the formation 20 into the wellbore.

The sealing material 30 swells when exposed to fluid in the well. Preferably, the sealing material 30 increases in volume and expands radially outward when a particular fluid or combination of fluids contacts the sealing material 30 in the well. For example, the sealing material 30 may swell in response to exposure to hydrocarbon fluid (such as oil or gas) and/or in response to exposure to water in the well. The sealing material 30 may be made, at least in part, of a rubber compound. In other embodiments, however, the sealing material 30 may be made of other materials.

Figure 2:
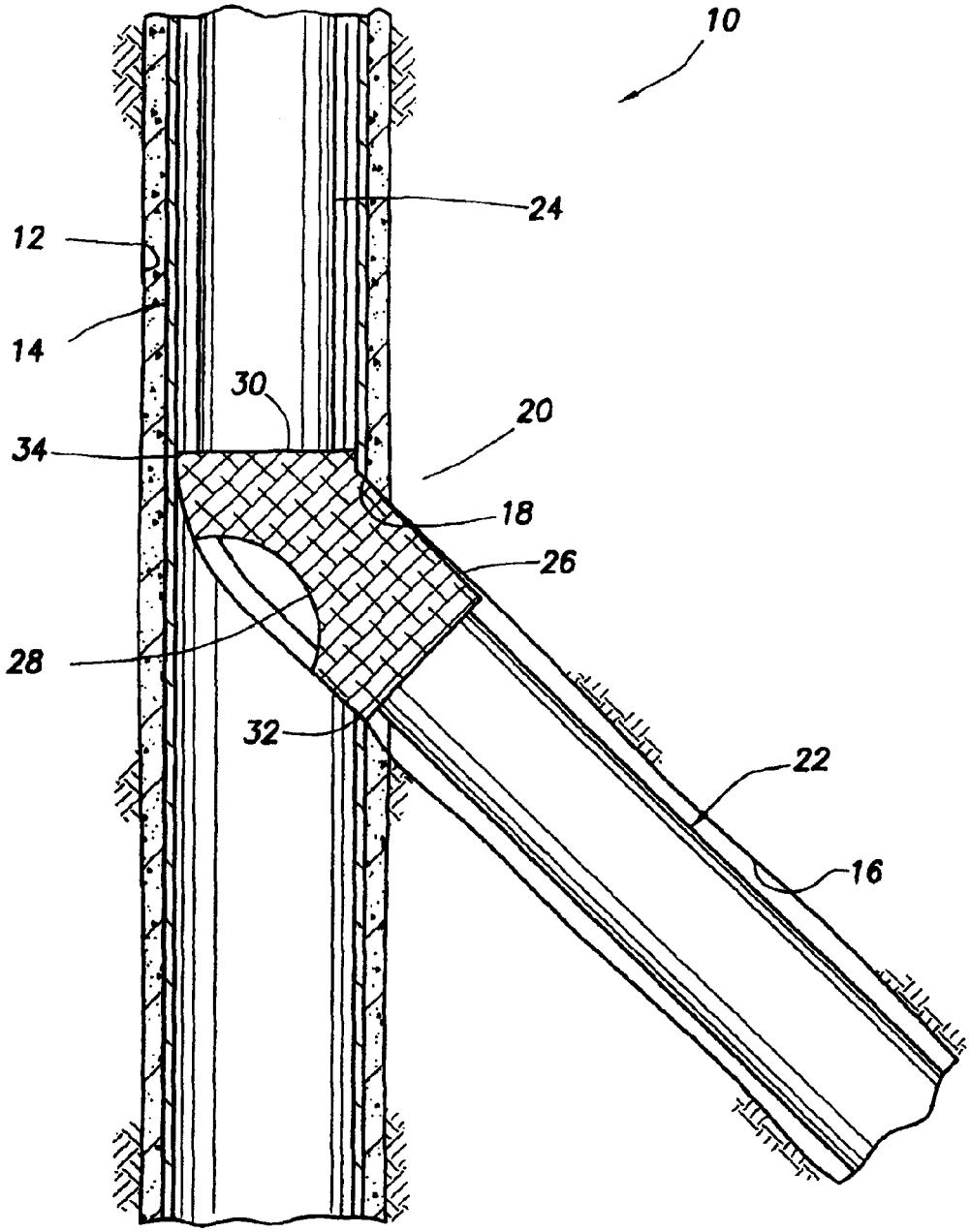
FIG. 2. is an illustration of a well completion system with a sealing material activated for sealing a transition zone between a parent wellbore and a branch wellbore according to an embodiment of the disclosure.

Referring now to FIG. 2, the system 10 is described after the sealing material 30 has swollen in the window 18. Note that the seal 32 is now formed by the swollen sealing material 30 between the transition joint 26 and the window 18. This seal 32 may be used, in part, to prevent particulate matter including fines, sand, and other material from propagating from the formation 20 into the parent wellbore 12, specifically preventing particulate matter from passing between the sides of the transition joint 26 and the parent and branch wellbores 12, 16 into the transition joint 26 and/or the parent wellbore 12. The tubular string 24 could be cemented into the branch wellbore 16 before or after the seal 32 is formed. In addition, the sealing material 30, when swollen, may provide another seal 34 between the transition joint 26 and the casing 14 in the parent wellbore 12. The seal 34 can be used as an annular barrier above the opening 28. Note that the opening 28 is conveniently positioned between the seals 32, 34 for providing fluid communication between the interior of the tubular string 24 and the parent wellbore 12 below the window 18.

When the sealing material 30 has swollen in the window 18 and formed the seal 32 and optionally the seal 34, the apertures in the sealing material 30 and in the transition joint 26 relieve formation pressure that may be present in the formation 20. Without the apertures, formation pressure may break one of the seal 32 and the seal 34 and drive particulate matter under high pressure past the seals 32, 34, eroding the sealing material 30 over time. The relief of the formation pressure by the apertures reduces the pressure differential between the formation 20 and the parent wellbore 12 sufficiently to reduce stress on the seals 32, 34 to a manageable level, for example to less than about 50 PSI.

Figure 3A:
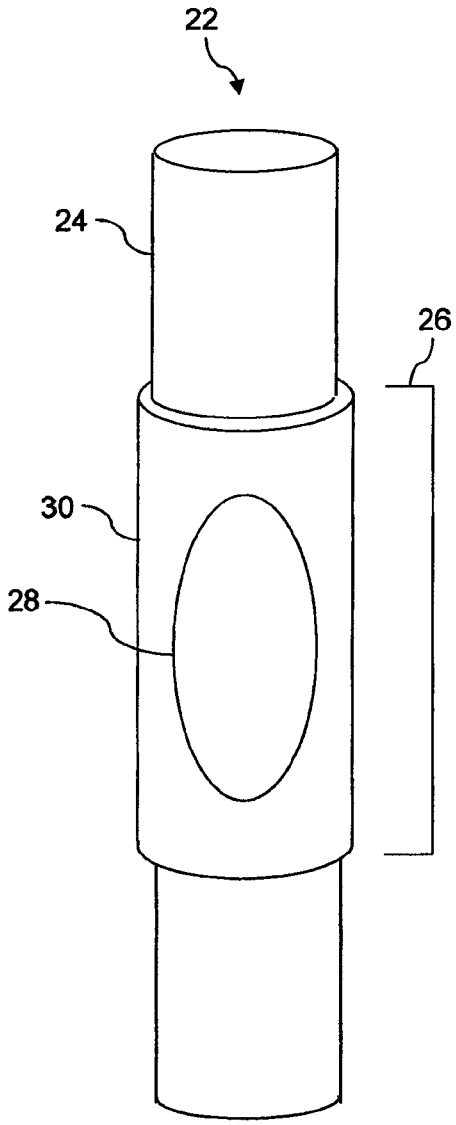
FIG. 3A is an illustration of a side view of a transition joint in a first position according to an embodiment of the disclosure.
Figure 3B:
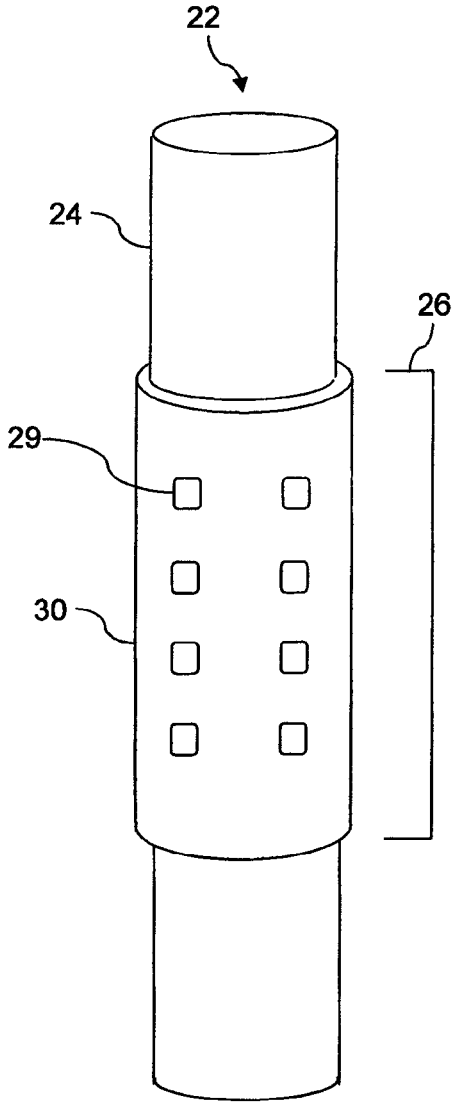
FIG. 3B is an illustration of a side view of the transition joint in a second position according to an embodiment of the disclosure.
Figure 3C:
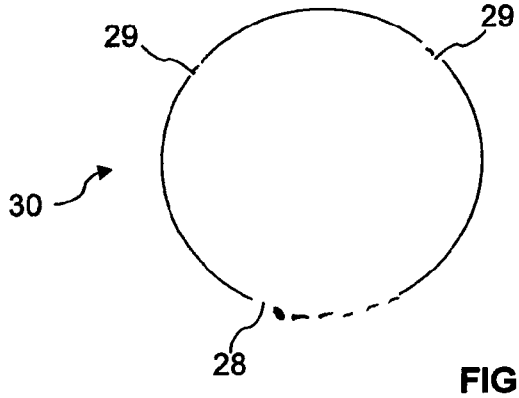
FIG. 3C is an illustration of a top view of the transition joint according to an embodiment of the disclosure.

Turning now to FIG. 3A, FIG. 3B, FIG. 3C, and FIG. 3D, the assembly 22 is discussed further. In FIG. 3A, a first side of the assembly 22 is viewed. In FIG. 3B, a second side of the assembly 22 is viewed, where the second view is about opposite of the first view. In FIG. 3C, a top view of the assembly 22 is shown. As best seen in FIG. 3C, the opening 28 is located on an opposite side of the sealing material 30 from a plurality of apertures 29 in the sealing material 30. The opening 28 located in the tubular string 24 may be aligned with a corresponding opening in the sealing material 30. In an embodiment, the apertures 29 in the sealing material 30 are located in horizontal rows about 120 degrees apart from each other in the horizontal direction. In an embodiment, the apertures 29 are about 4 square inches in area. In another embodiment, the apertures 29 may have a different size and area. The size of the apertures 29 is designed to take into account the swelling of the sealing material 30 when activated by at least one of hydrocarbons and/or water in the wellbore, to avoid the apertures 29 closing when the sealing material 30 swells. While illustrated as roughly rectangular, the apertures 29 may take other shapes. The apertures 29 may have straight shoulders or they may be beveled or rounded.

Figure 3D:
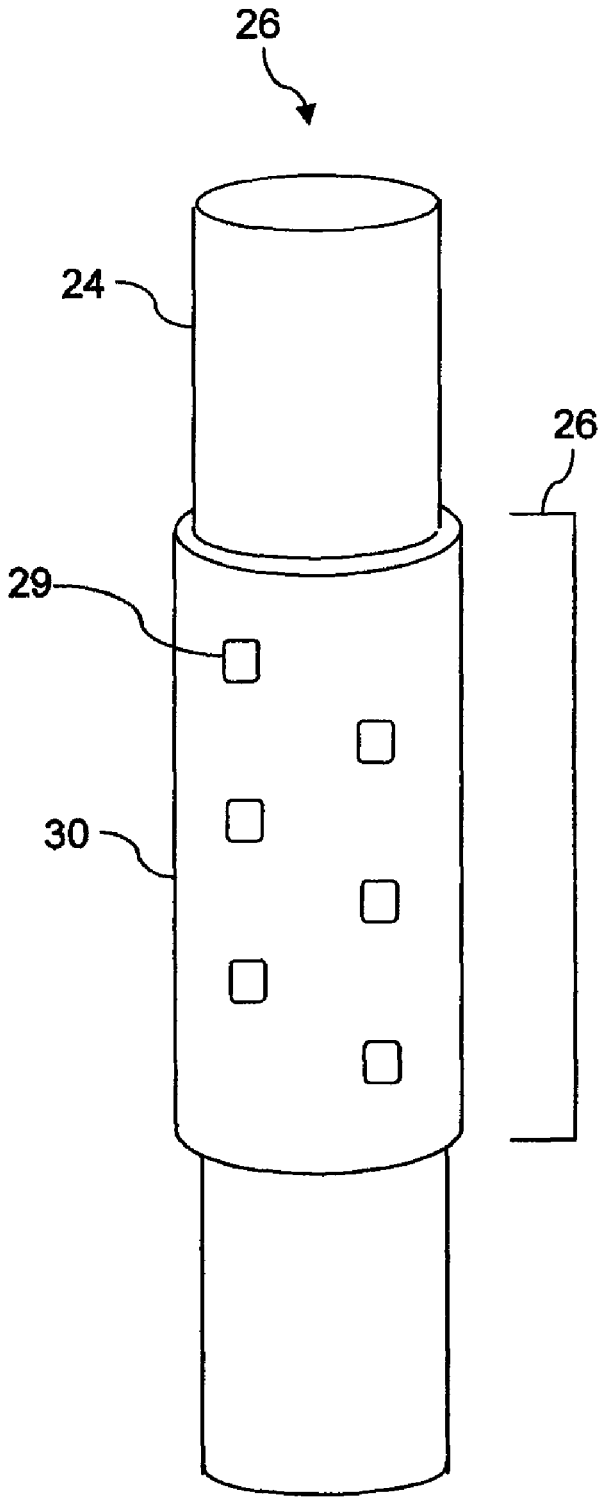
FIG. 3D is an illustration of a side view of the transition joint according to an embodiment of the disclosure.

In an embodiment, the assembly 22 may be about 40 feet long and the sealing material 30 may be about 20 feet to about 30 feet long. In an embodiment, the sealing material 30 is about 25 feet long. In an embodiment, the rows of apertures 29 may be separated in the range from about 3 feet to about 5 feet apart vertically. As illustrated in FIG. 3D, in an embodiment, the apertures 29 may be staggered with respect to each other.

In an embodiment, the tubular string 24 may be 7⅝ inches outside diameter and 6⅛ inches inside diameter, but in other embodiments the tubular string 24 may have a different outside and/or inside diameter. In an embodiment, the sealing material 30 may have a pre-swelling outside diameter of 8⅜ inches, but in other embodiments the sealing material 30 may have a different pre-swelling outside diameter. In one embodiment, when installed in the window 18, the side of the assembly 22 illustrated in FIG. 3B is oriented towards the window 18 and the formation 20 while the side of the assembly 22 illustrated in FIG. 3A is oriented away from the window 18 and the formation 20.

Figure 4A:
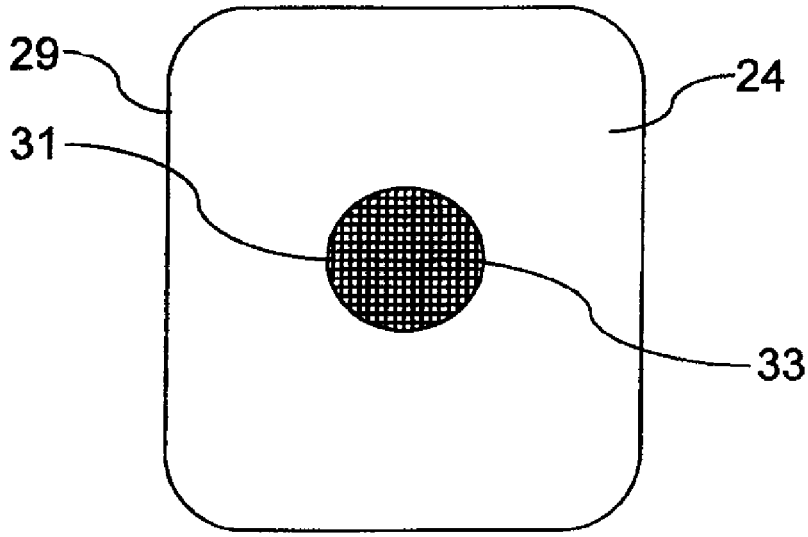
FIG. 4A is an illustration of a pressure relieving means according to an embodiment of the disclosure.

Turning now to FIG. 4A, a means for relieving differential pressure between the formation 20 and an interior of the assembly 22 is described. In an embodiment, the tubular string 24 has a plurality of apertures 31 aligned with the apertures 29 in the sealing material 30. In an embodiment, the apertures 29 may each be less than about 1 square inches in area. In an embodiment, the apertures 29 may be circular and have a diameter of less than about 1 inch. In an embodiment, the apertures 29 may be circular and have a diameter in the range of about 0.04 inches to about 0.3 inches. The tubular string 24 may be coupled to a plurality of screens 33 to block or reduce the passage of particulate matter, for example fines and/or sand, from the formation 20 into the wellbore. The screens 33 may be retained within the apertures 29 by snap rings. The apertures 29 may be at least partly threaded, and the screens 33 may screw into the threading in the apertures 29. The screens 33 may be welded to the tubular string 24 over the apertures 29. The screens 33 may be adhered to the tubular string 24 using epoxy or other adhesives. The screens 33 may be coupled to the tubular string 24 using other means known to those skilled in the art. The screens 33 may be aligned with the apertures 31. The screens 33 may be attached to the outside of the tubular string 24 over the apertures 31 or on the inside of the tubular string 24. In an embodiment, the tubular string 24 or a portion of the tubular string 24, for example the transition joint 26, may comprise a screen structure.

When the assembly 22 is run in, the apertures 29, 31 and the screens 33 allow fluid flow from the formation 20 to pass into the assembly 22 and into the wellbore, thereby relieving a pressure differential between the exterior and interior of the assembly 22, while substantially blocking particulate matter. For example, sand from the formation 20 may pack against the screens 33 but allow fluid passage. In an embodiment, the screens 33 may allow fluid flow from the formation 20 into the assembly 22 but block fluid from the assembly 22 into the formation 20. In another embodiment, the screens 33 may be replaced with permeable filters. In an alternative, embodiment, the screens 33 may be replaced with pressure relief valves (not shown) which open to allow fluid flow to reduce a pressure differential between the formation 20 and the interior of the assembly 22 while also blocking passage of particulate matter into the wellbore and closing to block fluid flow from the interior of the assembly to the formation 20.

Figure 4B:
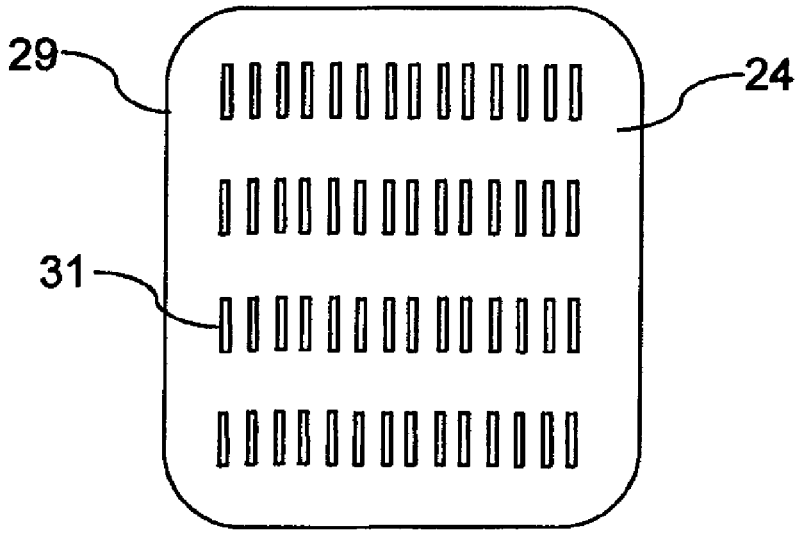
FIG. 4B is an illustration of another pressure relieving means according to an embodiment of the disclosure.

Turning now to FIG. 4B, another means for relieving differential pressure between the formation 20 and an interior of the assembly 22 is described. In an embodiment, the tubular string 24 is at least partially constructed of slotted tubing. For example, the tubular string 24 may be constructed of tubing having slots in the range of about 0.01 inches to about 0.04 inches wide and in the range about 1.5 inches to about three inches long. In another embodiment, other slot sizes may be employed that are effective to block and/or exclude transport of particulate matter from the formation 20 into the wellbore. The apertures 31 in the tubular string 24 may be provided by the slots. The apertures 31 may allow fluid flow from the formation 20 into the interior of the assembly 22, thereby relieving and reducing a pressure differential between the formation 20 and the wellbore, while blocking the entry of particulate matter, for example fines and/or sand, from the formation into the wellbore. For example, sand from the formation 20 may pack against the apertures 31 in the tubular string 24 provided by the slots but allow fluid passage through the slots into the wellbore.

In an embodiment, the tubular string 24 may not have the sealing material 30. In this embodiment, the lower end of the tubular string 24 is deflected into the branch wellbore 16, and fluid flows from the formation 20 into the wellbore through the apertures 31 in the tubular string 24 and around the junction of the window 18 with the assembly 22. Sand packs against the screens 33 and/or apertures 31 and in the junction of the window 18 with the assembly 22. While initially some sand and/or particulate matter may propagate through the junction of the window 18 with the assembly 22, as the particulate matter packs the junction further propagation of sand and/or particulate matter stops.

Figure 5A:
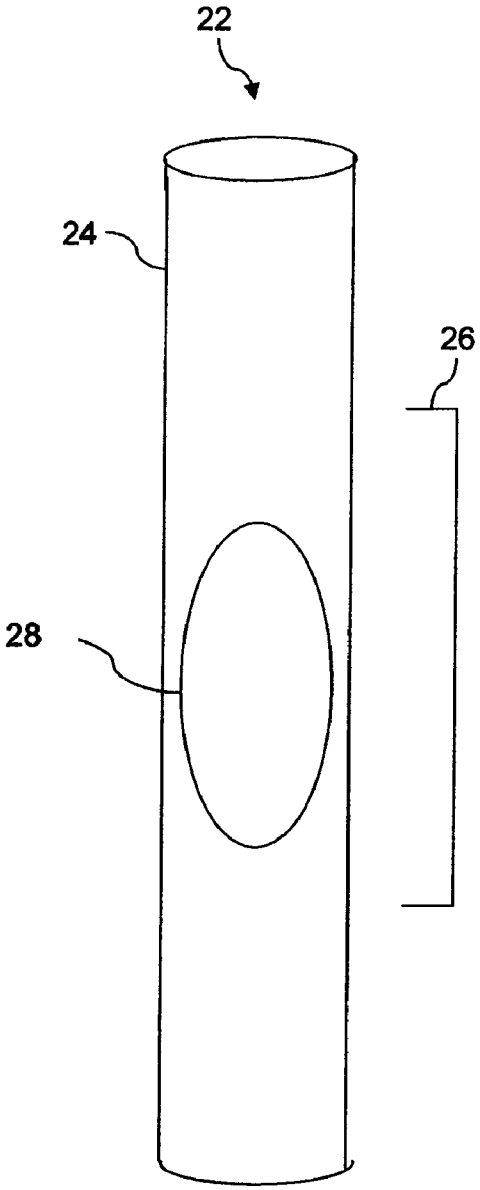
FIG. 5A is an illustration of a side view of a transition joint in a first position showing an opening in a metal tubular according to an embodiment of the disclosure.
Figure 5B:
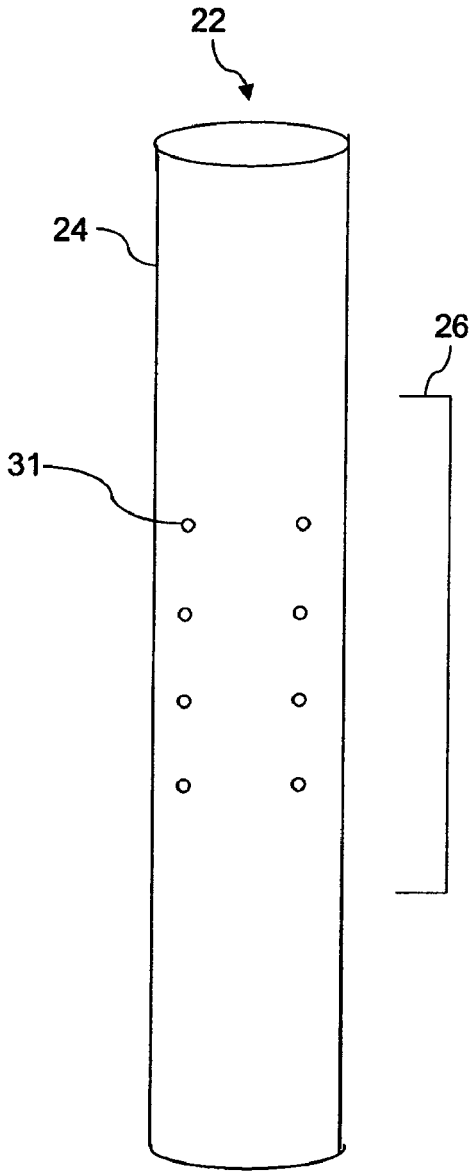
FIG. 5B is an illustration of a side view of the transition joint in a second position showing apertures in a metal tubular according to an embodiment of the disclosure.
Figure 5C:
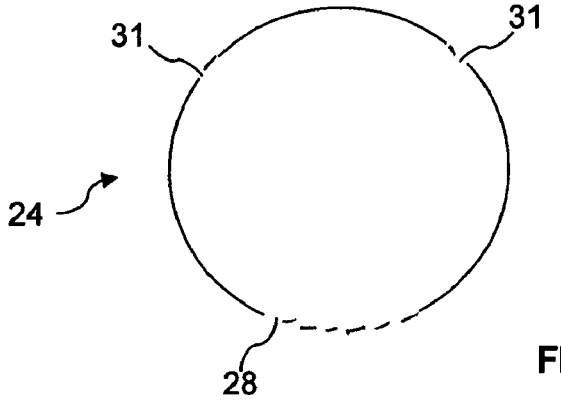
FIG. 5C is an illustration of a top view of the transition joint showing an opening and apertures in a metal tubular according to an embodiment of the disclosure.
Figure 5D:
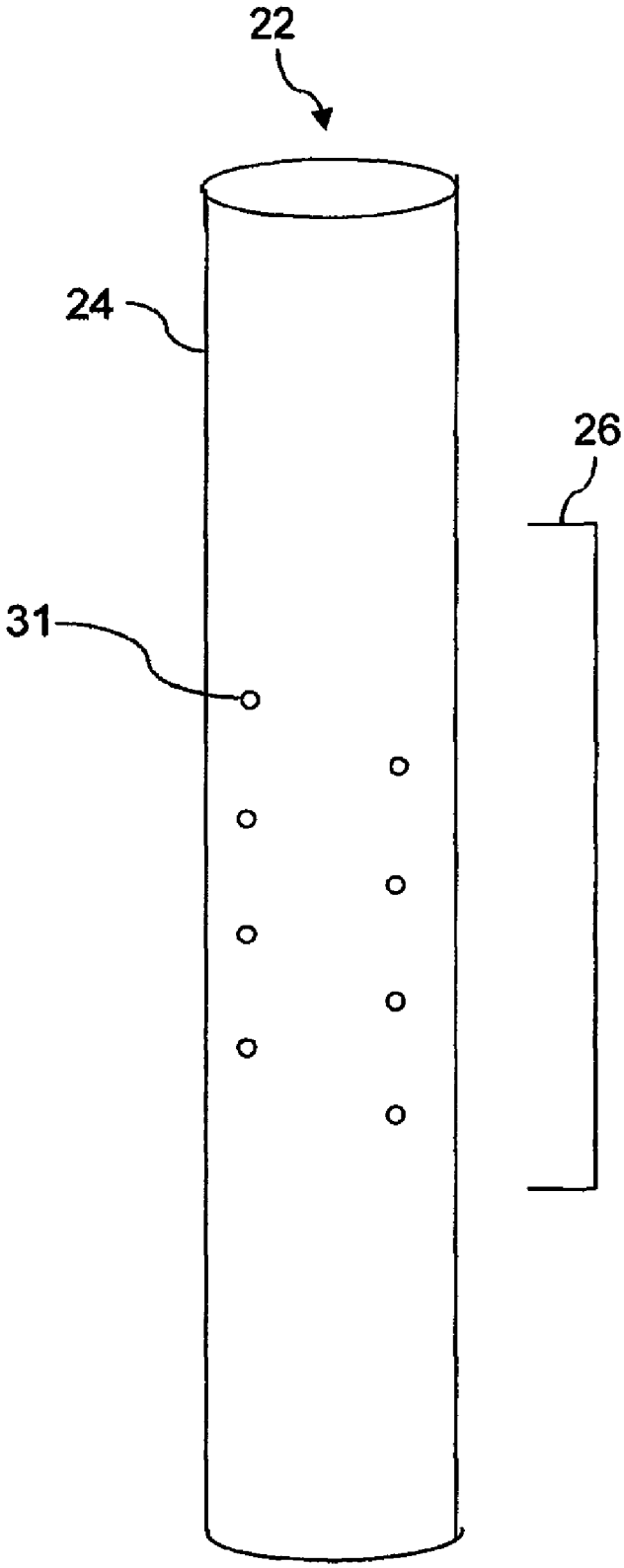
FIG. 5D is an illustration of a side view of the transition joint showing apertures in a metal tubular according to an embodiment of the disclosure.

Turning now to FIG. 5A, FIG. 5B, FIG. 5C, and FIG. 5D the spatial relationship between the opening 28 in the tubular string 24 and the apertures 31 in the tubular string 24 are discussed. The apertures 31 may be disposed in horizontal rows, apertures 31 in the same row horizontally offset from each other by about 120 degrees. The apertures 31 may be on a side of the tubular string 24 about opposite of the side of the tubular string containing the opening 28. In an embodiment, the horizontal row of apertures 31 may be located in the range of about every three feet to about five feet vertically along the tubular string 24. As illustrated in FIG. 5D, the apertures 31 may be staggered and/or offset from each other.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A transition joint for coupling a parent wellbore to a branch wellbore extending outwardly from a window in the parent wellbore, comprising:

a tubular string comprising an upper portion configured to be contained in the parent wellbore upwards from the window, a lower portion configured to be contained in the branch wellbore, and a plurality of apertures configured to allow fluid flow into the tubular string from a formation proximate to the window, wherein the plurality of apertures are arranged on the tubular string along a half of the tubular string configured to face a pressure gradient between the formation and the branch wellbore; and a plurality of pressure relief valves coupled to the apertures in the tubular string, wherein each of the pressure relief valves is configured to be autonomously actuating, and wherein the plurality of pressure relief valves are configured to reduce propagation of particulate matter into the parent wellbore and the branch wellbore when the plurality of pressure relief valves are open.

2. The transition joint of claim 1, wherein the pressure relief valves block propagation of particulate matter into the parent wellbore and the branch wellbore when the pressure relief valves are open.

3. The transition joint of claim 1, further comprising:

a seal coupled to the tubular string at the junction of the parent wellbore and the branch wellbore configured to block transport of particulate matter from the formation proximate to the window into the parent wellbore, the seal selected from the group consisting of an injection foam, and injection gel, and a swellable seal.

4. The transition joint of claim 3, wherein the seal is the swellable seal and the swellable seal comprises a plurality of apertures, wherein at least one of the plurality of apertures in the swellable seal is aligned with at least one of the plurality of apertures in the tubular string, and wherein the at least one of the apertures in the swellable seal is sized to avoid closing the aligned at least one of the apertures in the tubular string when the swellable seal swells.

5. The transition joint of claim 4, wherein the swellable seal is configured to swell in volume when exposed to at least one of hydrocarbons and water.

6. The transition joint of claim 1, wherein the pressure relief valves are configured to allow fluid flow from the formation proximate to the window into the tubular string and further configured to substantially block crossflow of fluid into the formation proximate to the window.

7. The transition joint of claim 1, wherein the tubular string is a metal pipe.

8. The transition joint of claim 1, wherein the tubular string further comprises a wall opening along a half of the tubular string opposite the half of the tubular string on which the plurality of apertures are arranged, the wall opening configured to provide fluid communication between the parent wellbore below the window and the interior of the tubular string.

9. The transition joint of claim 1, wherein a second half of the tubular string opposite the half of the tubular string configured to face a pressure gradient between the formation and the branch wellbore does not comprise any of the plurality of apertures.

10. A transition joint for coupling a parent wellbore to a branch wellbore extending outwardly from a window in the parent wellbore, comprising:

a tubular string comprising an upper portion configured to be contained in the parent wellbore upwards from the window, a lower portion configured to be contained in the branch wellbore, and a plurality of apertures configured to allow fluid flow into the tubular string from a formation proximate to the window, wherein the plurality of apertures are arranged on the tubular string along a half of the tubular string configured to face a pressure gradient between the formation and the branch wellbore; and a plurality of pressure relief valves coupled to the apertures in the tubular string, wherein the pressure relief valves are configured to reduce propagation of particulate matter into the parent wellbore and the branch wellbore when the pressure relief valves are open.

11. The transition joint of claim 10, wherein the pressure relief valves block propagation of particulate matter into the parent wellbore and the branch wellbore when the pressure relief valves are open.

12. The transition joint of claim 10, further comprising:

a seal coupled to the tubular string at the junction of the parent wellbore and the branch wellbore configured to block transport of particulate matter from the formation proximate to the window into the parent wellbore, the seal selected from the group consisting of an injection foam, and injection gel, and a swellable seal.

13. The transition joint of claim 12, wherein the seal is the swellable seal and the swellable seal comprises a plurality of apertures, wherein at least one of the plurality of apertures in the swellable seal is aligned with at least one of the plurality of apertures in the tubular string, and wherein the at least one of the apertures in the swellable seal is sized to avoid closing the aligned at least one of the apertures in the tubular string when the swellable seal swells.

14. The transition joint of claim 10, wherein the pressure relief valves are configured to allow fluid flow from the formation proximate to the window into the tubular string and further configured to substantially block crossflow of fluid into the formation proximate to the window.

15. The transition joint of claim 10, wherein the tubular string is a metal pipe.

16. The transition joint of claim 10, wherein the tubular string further comprises a wall opening along a half of the tubular string opposite the half of the tubular string on which the plurality of apertures are arranged, the wall opening configured to provide fluid communication between the parent wellbore below the window and the interior of the tubular string.

17. A method of completing a wellbore having a branch wellbore extending outwardly from a window in a parent wellbore, the method comprising:

positioning a transition joint in the window, wherein the positioning comprises deflecting the transition joint from the parent wellbore into the branch wellbore, wherein the transition joint comprises a tubular string and a plurality of apertures configured to allow fluid flow into the tubular string from a formation proximate to the window, wherein the plurality of apertures are arranged on the tubular string only along a half of the tubular string configured to face a pressure gradient between the formation and the branch wellbore, and where in the transition joint further comprises a plurality of pressure relief valves coupled to the apertures in the tubular string, wherein each of the pressure relief valves is configured to be autonomously actuating; and the transition joint passing fluid into the tubular string proximate the window from a formation proximate to the window while substantially excluding transport of particulate matter from the formation proximate to the window into the tubular string.

18. Method of claim 17, wherein the transition joint further comprises a seal coupled to the tubular string at a junction of the parent wellbore and the branch wellbore, wherein the seal is configured to block transport of particulate matter from the formation proximate to the window into the parent wellbore, the seal selected from the group consisting of an injection foam, and injection gel, and a swellable seal.

19. The method of claim 17, wherein the pressure relief valves are configured to allow fluid flow from the formation proximate to the window into the tubular string and further configured to substantially block crossflow of fluid into the formation proximate to the window.

20. The method of claim 17, wherein the pressure relief valves reduce propagation of particulate matter into the parent wellbore and the branch wellbore when the pressure relief valves are open.

* * * * *